US007551861B2

(12) United States Patent
Hughes et al.

(10) Patent No.: US 7,551,861 B2
(45) Date of Patent: Jun. 23, 2009

(54) METHOD FOR PERFORMING QUALITY CHECKS ON A PRINT ENGINE FILM LOOP

(75) Inventors: Mark K. Hughes, Spencerport, NY (US); Frederick E. Altrieth, III, Scottsville, NY (US); Thomas R. Hull, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 76 days.

(21) Appl. No.: 11/111,184

(22) Filed: Apr. 21, 2005

(65) Prior Publication Data

US 2005/0248798 A1 Nov. 10, 2005

Related U.S. Application Data

(60) Provisional application No. 60/568,295, filed on May 5, 2004.

(51) Int. Cl.
*G03G 15/00* (2006.01)

(52) U.S. Cl. ..... 399/15; 399/26

(58) Field of Classification Search ..... 399/15, 399/26

See application file for complete search history.

(56) References Cited

U.S. PATENT DOCUMENTS

| | | | | |
|---|---|---|---|---|
| 5,077,576 | A * | 12/1991 | Stansfield et al. | 399/31 |
| 5,173,733 | A * | 12/1992 | Green | 399/26 |
| 5,956,544 | A | 9/1999 | Stern et al. | |
| 6,121,986 | A | 9/2000 | Regelsberger et al. | |
| 6,175,700 | B1 * | 1/2001 | Miller et al. | 399/72 |

FOREIGN PATENT DOCUMENTS

| | | |
|---|---|---|
| WO | WO 01/89194 A2 | 11/2001 |
| WO | WO 02/10860 A1 | 2/2002 |
| WO | WO 02/14957 A1 | 2/2002 |

* cited by examiner

*Primary Examiner*—David M Gray
*Assistant Examiner*—Joseph S Wong
(74) *Attorney, Agent, or Firm*—William R. Zimmerli

(57) ABSTRACT

A quality check of the photoconductive belt of an electrographic print engine may be performed by writing a toner image on each of the virtual image frames of the loop and printing out those images. The printer user interface may provide a test screen to prompt a user to perform such a quality check. To facilitate the printing of sample receivers for each frame of a printer's film loop a user button is provided at the user interface. When selected, this signals the marking engine to schedule for print an appropriate number of receivers such that each frame on the film belt will be printed on. Each receiver may be a duplicate copy of a particular receiver in the currently printing job.

16 Claims, 6 Drawing Sheets

METHOD FOR PERFORMING QUALITY CHECKS ON A PRINT ENGINE FILM LOOP

CROSS-REFERENCE TO RELATED APPLICATIONS

This application claims the priority date of U.S. Provisional Application Ser. No. 60/568,295, filed May 5, 2004, entitled "METHOD FOR PERFORMING QUALITY CHECKS ON A PRINT ENGINE FILM LOOP".

FIELD OF THE INVENTION

This invention is in the field of digital printing, and is more specifically directed to quality control in electrostatographic printers.

BACKGROUND

Electrographic printing has become the prevalent technology for modern computer-driven printing of text and images, on a wide variety of hard copy media. This technology is also referred to as electrographic marking, electrostatographic printing or marking, and electrophotographic printing or marking. Conventional electrographic printers are well suited for high resolution and high speed printing, with resolutions of 600 dpi (dots per inch) and higher becoming available even at modest prices.

In today's printing operations it is extremely important that very little waste of consumables occurs during the printing of jobs. If one or more jobs have to be re-printed due to a printer defect then the cost of that re-print is born by the printer operator. This results in an overall loss in profitability associated with that job(s).

Efforts regarding printers or printing systems have led to continuing developments to improve their versatility practicality, and efficiency.

DETAILED DESCRIPTION

The present invention provides hardware components, and the associated methods for their operation, that are particularly suited to be implemented in a multicolor printing process. One embodiment of the invention utilizes an endless loop for recording the image, or transporting an image receiver on the endless loop. However, it is envisioned that other embodiments can also employ the components and methods of the present invention. The present invention is suited for color printing, monochrome printing, monochrome printing devices with accent color capability and other variations.

Figure 1:
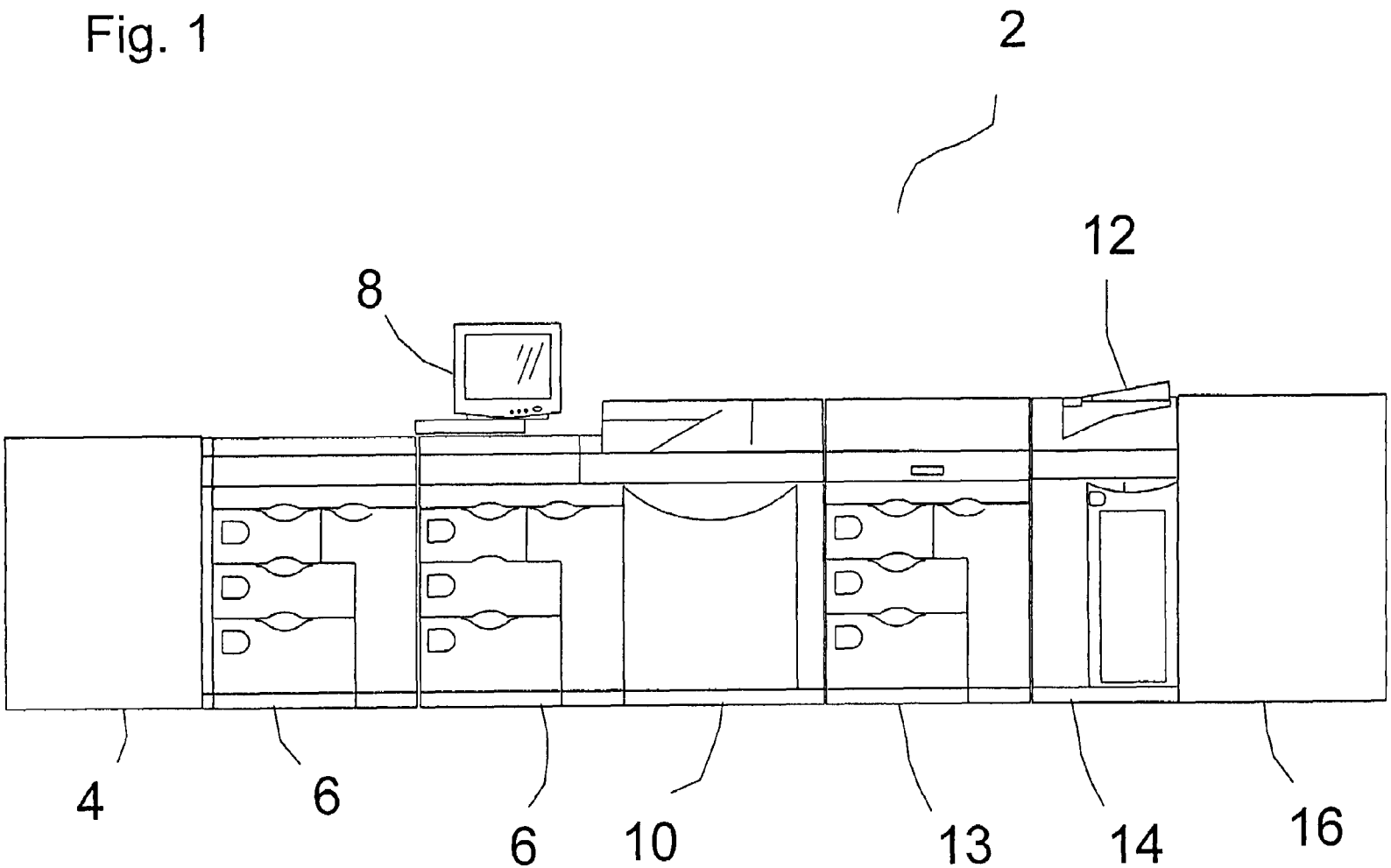
FIG. 1 is a schematic block diagram of a printer in accordance with the present invention.

Referring now to FIG. 1, wherein a print system 2 is comprised of a media treatment system 4 for treating media to be printed. The print system may be electrostatographic, ink jet, laser jet, or other type of printing device. Media may include paper, cardboard, plastic, metal receivers, or any of a number of materials to which a marking material is to be adhered to in a predefined pattern or image. The treated media is provided to a marking engine 10. Media to be printed on is also referred to as a receiver. For exemplary purposes, a media supply 6 is shown, wherein the treated media, and perhaps other media may be stacked in trays, finishing device, exited from the printer, or otherwise organized. The print system is controlled via a user interface 8 which may be remotely located from the print engine 10. The printed media may be supplied to an inserting device 13, a stacking device 12, 14 and/or a finishing device 16.

Figure 2:
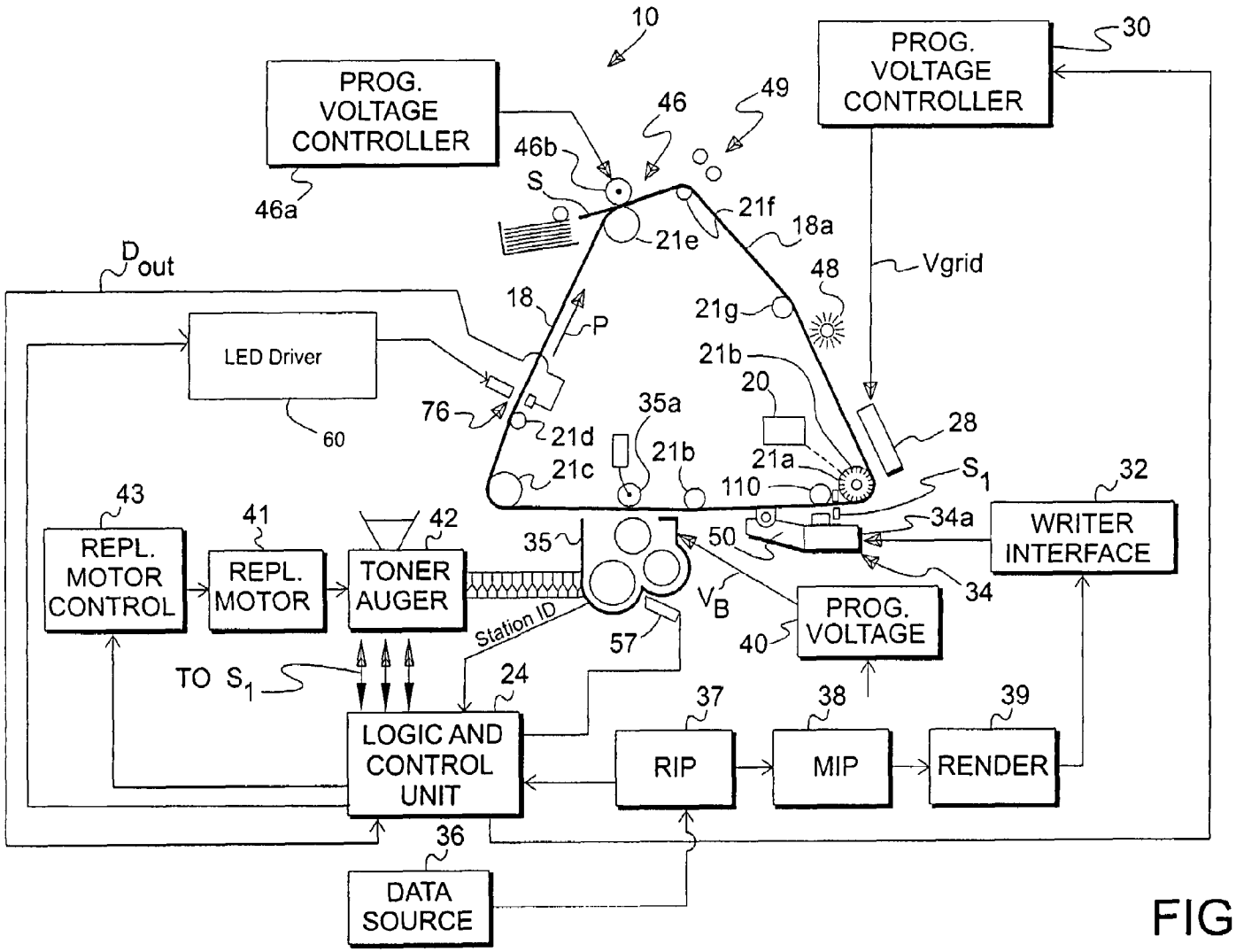
FIG. 2 is a schematic block diagram of a marking engine in accordance with the present invention.
Figure 3:
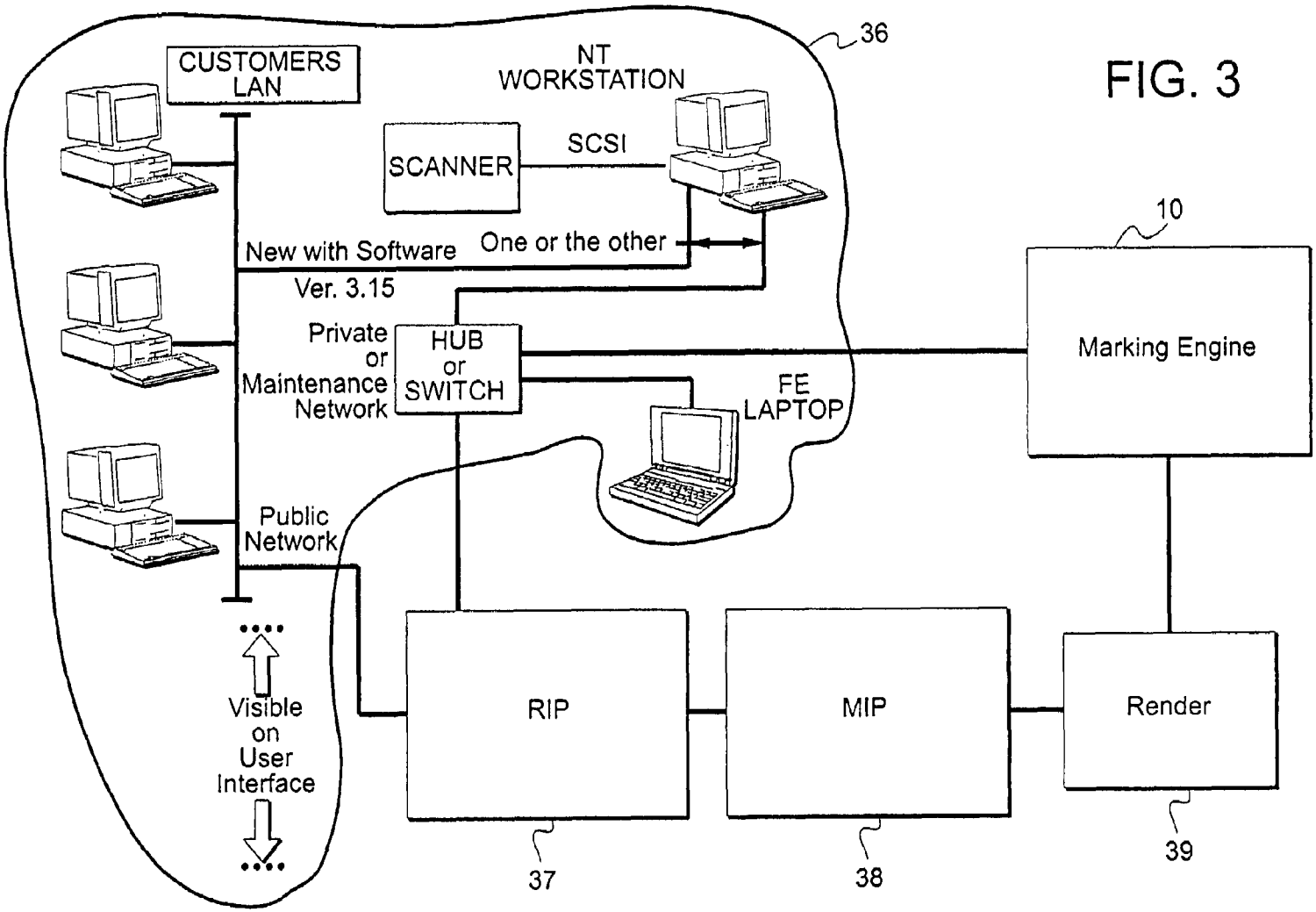
FIG. 3 is a schematic block diagram of a printing system in accordance with the present invention.

Referring to FIGS. 2 and 3, the printer or marking engine 10 is an electrostatographic printer, and includes a moving recording member such as a photoconductive substrate (or film), which may be configured in the shape of a belt or loop 18 (also be referred to as a film loop) or other shape which is entrained about a plurality of rollers or other supports 21*a* through 21*g*, one or more of which is driven by an advancing motor 20. The film loop 18 can be described as having one or more virtual frames on which toner will be deposited as described hereinafter. By way of example, roller 21*a* is illustrated as being driven by motor 20. Motor 20 advances the belt in the direction indicated by arrow P past a series of workstations of the printer 10. Alternatively, belt 18 may be wrapped and secured about or configured as a single drum.

Printer 10 includes a controller or logic and control unit (LCU) 24, such as a digital computer or microprocessor operating according to a stored program for sequentially actuating the workstations within printer 10, effecting overall control of printer 10 and its various subsystems. LCU 24 also is programmed to provide closed-loop control of printer 10 in response to signals from various sensors and encoders. Aspects of process control are described in U.S. Pat. No. 6,121,986 incorporated herein by this reference.

A primary charging station 28 in printer 10 sensitizes belt 18 by applying a uniform electrostatic corona charge, from high-voltage charging wires at a predetermined primary voltage, to a surface 18*a* of belt 18 within one of the virtual frames. The output of charging station 28 is regulated by a programmable voltage controller 30 (such as a high voltage power supply with a suitable controller), which is in turn controlled by LCU 24 to adjust this primary voltage, for example by controlling the electrical potential of a grid and thus controlling movement of the corona charge. Other forms of chargers, including brush or roller chargers, may also be used.

An exposure station 34 in printer 10 projects light from a writer 34*a* to belt 18. This light selectively dissipates the electrostatic charge on photoconductive belt 18 to form a latent electrostatic image of the document to be copied or printed. Writer 34*a* may be constructed as an array of light emitting diodes (LEDs), or alternatively as another light source such as a laser, flash lamp, or spatial light modulator. Writer 34*a* exposes individual picture elements (pixels) of belt 18 with light at a regulated intensity and exposure, in the manner described below. The exposing light discharges selected pixel locations of the photoconductor, so that the pattern of localized voltages across the photoconductor corresponds to the image to be printed. An image is a pattern of physical light which may include characters, words, text, and other features such as graphics, photos, etc. An image may be included in a set of one or more images, such as in images of the pages of a document. An image may be divided into segments, objects, or structures each of which is itself an image. A segment, object or structure of an image may be of any size up to and including the whole image.

Image data to be printed is provided by an image data source 36, which is a device that can provide digital data defining a version of the image. Such types of devices are numerous and include computer or microcontroller, computer workstation, scanner, digital camera, etc. These data represent the location and intensity of each pixel that is exposed by the printer. Signals from data source 36, in combination with control signals from LCU 24 are provided to a raster image processor (RIP) 37. The digital images (including styled text) are converted by the RIP 37 from their form in a page description language (PDL) to a sequence of serial instructions for the electrographic printer in a process commonly referred to as "ripping" and which provides a ripped image to an image storage and retrieval system referred to as a marking image processor (MIP) 38.

In general, the major roles of the RIP 37 are to: receive job information from the server; parse the header from the print job and determine the printing and finishing requirements of the job; analyze the PDL (Page Description Language) to reflect any job or page requirements that were not stated in the header; resolve any conflicts between the requirements of the job and the marking engine configuration (i.e., RIP time mismatch resolution); keep accounting record and error logs and provide this information to any subsystem, upon request; communicate image transfer requirements to the marking engine; translate the data from PDL (Page Description Language) to raster for printing; and support diagnostics communication between user applications. The RIP accepts a print job in the form of a Page Description Language (PDL) such as PostScript, PDF or PCL and converts it into raster, a form that the marking engine can accept. The PDL file received at the RIP describes the layout of the document as it was created on the host computer used by the customer. This conversion process is called rasterization. The RIP makes the decision on how to process the document based on what PDL the document is described in. It reaches this decision by looking at the first 2K of the document. A job manager sends the job information to the Marking Subsystem Services (which is part of a LCU) via Ethernet and the rest of the document further into the RIP to get rasterized. For clarification, the document header contains printer-specific information such as whether to staple or duplex the job. Once the document has been converted to raster by one of the interpreters, the raster data goes to the MIP 38 via RTS (Raster Transfer Services), which transfers the data over a IDB (Image Data Bus).

The MIP functionally replaces recirculating feeders on optical copiers. This means that images are not mechanically rescanned within jobs that require rescanning, but rather, images are electronically retrieved from the MIP to replace the rescan process. The MIP accepts digital image input and stores it for a limited time so it can be retrieved and printed to complete the job as needed. The MIP consists of memory for storing digital image input received from the RIP. Once the images are in MIP memory, they can be repeatedly read from memory and output to the render circuit. The amount of memory required to store a given number of images can be reduced by compressing the images. The images may be compressed prior to MIP memory storage, then decompressed while being read from MIP memory.

The output of the MIP is provided to an image render circuit 39, which alters the image and provides the altered image to the writer interface 32 (otherwise known as a write head, print head, etc.) which applies exposure parameters to the exposure medium, such as a photoconductor 18.

After exposure, the portion of exposure medium belt 18 bearing the latent charge images travels to a development station 35. Development station 35 includes a magnetic brush in juxtaposition to the belt 18. Magnetic brush development stations and other types of development stations or devices may be used. Plural development stations 35 may be provided for developing images in plural colors, or from toners of different physical characteristics. Accent color or process color electrographic printing is accomplished by utilizing this process for one or more of four or more toner colors (e.g., cyan, magenta, yellow and black (CMYK)). To this end, specialty colors toner development stations may be provided to provide the ability to print specialty colors not normally attainable with typical CMYK mixtures. A sensor may be provided on each development station which identifies the station to the LCU via a Station ID line. In this manner, the LCU is notified of what colors toners are being utilized.

Upon the imaged portion of belt 18 reaching development station 35, LCU 24 selectively activates development station 35 to apply toner to belt 18 by moving backup roller 35*a* into engagement with belt 18 or close proximity to the magnetic brush. Alternatively, the magnetic brush may be moved toward belt 18 to selectively engage belt 18. In either case, charged toner particles on the magnetic brush are selectively attracted to the latent image patterns present on belt 18, developing those image patterns. As the exposed photoconductor passes the developing station, toner is attracted to pixel locations of the photoconductor and as a result, a pattern of toner corresponding to the image to be printed appears on the photoconductor. Conductor portions of development station 35, such as conductive applicator cylinders, are biased to act as electrodes. The electrodes are connected to a variable supply voltage, which is regulated by programmable controller 40 in response to LCU 24, by way of which the development process is controlled.

Development station 35 may contain a two component developer mix which comprises a dry mixture of toner and carrier particles. Typically the carrier may have high coercivity (hard magnetic) ferrite particles. As an example, the carrier particles have a volume-weighted diameter of approximately 30 microns. The dry toner particles are substantially smaller, on the order of 6 microns to 15 microns in volume-weighted diameter. Development station 35 may include an applicator having a rotatable magnetic core within a shell, which also may be rotatably driven by a motor or other suitable driving devices. Relative rotation of the core and shell moves the developer through a development zone in the presence of an electrical field. For this type of development, the toner selectively electrostatically adheres to photoconductive belt 18 to develop the electrostatic images thereon and the carrier material remains at development station 35. As toner is depleted from the development station due to the development of the electrostatic image, additional toner is periodically introduced by toner auger 42 into development station 35 to be mixed with the carrier particles to maintain a uniform amount of development mixture. This development mixture is controlled in accordance with various development control processes. Single component developer stations, as well as conventional liquid toner development stations, may also be used.

A transfer station 46 in marking engine 10 moves a receiver sheet S into engagement with photoconductive belt 18, in registration with a developed image to transfer the developed image to receiver sheet S. Receiver sheets S may be plain or coated paper, plastic, or another medium capable of being handled by printer 10. Typically, transfer station 46 includes a charging device for electrostatically biasing movement of the toner particles from belt 18 to receiver sheet S. In this example, the biasing device is roller 46*b*, which engages the back of receiver S and which is connected to programmable voltage controller 46*a* that operates in a constant current mode during transfer. Alternatively, an intermediate member may have the image transferred to it and the image may then be transferred to receiver sheet S. After transfer of the toner image to receiver sheet S, receiver S is detacked from belt 18 and transported to fuser station 49 where the image is fixed onto receiver S, typically by the application of heat. Alternatively, the image may be fixed to receiver S at the time of transfer.

A cleaning station 48, such as a brush, blade, or web is also located after transfer station 46, and removes residual toner from belt 18. A pre-clean charger (not shown) may be located before or at cleaning station 48 to assist in this cleaning. After cleaning, this portion of belt 18 is then ready for recharging and re-exposure. Other portions of belt 18 may be simultaneously located at the various workstations of marking engine 10, so that the printing process is carried out in a substantially continuous manner.

LCU 24 provides overall control of the print engine and various subsystems. LCU 24 will typically include temporary data storage memory, a central processing unit, timing and cycle control unit, and stored program control. Data input and output is performed sequentially through or under program control. Input data can be applied through input signal buffers to an input data processor, or through an interrupt signal processor, and include input signals from various switches, sensors, and analog-to-digital converters internal to marking engine 10, or received from sources external to marking engine 10, such from a human user or a network control. The output data and control signals from LCU 24 are applied directly or through storage latches to suitable output drivers and in turn to the appropriate subsystems within marking engine 10.

Process control strategies generally utilize various sensors to provide real-time closed-loop control of the electrostatographic process so that marking engine 10 generates "constant" image quality output, from the user's perspective. Real-time process control is necessary in electrographic printing, to account for changes in the environmental ambient of the photographic printer, and for changes in the operating conditions of the printer that occur over time during operation (rest/run effects). An important environmental condition parameter requiring process control is relative humidity, because changes in relative humidity affect the charge-to-mass ratio Q/m of toner particles. The ratio Q/m directly determines the density of toner that adheres to the photoconductor during development, and thus directly affects the density of the resulting image. System changes that can occur over time include changes due to aging of the printhead (exposure station), changes in the concentration of magnetic carrier particles in the toner as the toner is depleted through use, changes in the mechanical position of primary charger elements, aging of the photoconductor, variability in the manufacture of electrical components and of the photoconductor, change in conditions as the printer warms up after power-on, triboelectric charging of the toner, and other changes in electrographic process conditions. Because of these effects and the high resolution of modern electrographic printing, the process control techniques have become quite complex.

One such process control sensor is a densitometer 76, which monitors test patches that are exposed and developed in non-image areas of photoconductive belt 18. LCU controls drivers 60 which provide variable current to LEDs in a densitometer 76 and may include infrared or visible light LEDs, which either shines through the belt or is reflected by the belt onto a photodiode in densitometer 76. These toned test patches are exposed to varying toner density levels, including full density and various intermediate densities, so that the actual density of toner in the patch can be compared with the desired density of toner as indicated by the various control voltages and signals. The densitometer measurements are used in a feedback loop to control a number of process parameters, such as primary charging voltage $V_O$, maximum exposure light intensity $E_O$, development station cylinder bias $V_B$, etc. In addition, the process control of a toner replenishment control signal value or a toner concentration setpoint value to maintain the charge-to-mass ratio Q/m at a level that avoids dusting or hollow character formation due to low toner charge, and also avoids breakdown and transfer mottle due to high toner charge for improved accuracy in the process control of marking engine 10. The toned test patches are formed in the interframe area of belt 18 so that the process control can be carried out in real time without reducing the printed output Throughput. Another sensor useful for monitoring process parameters in printer 10 is electrometer probe 50, mounted downstream of the corona charging station 28 relative to direction P of the movement of belt 18. An example of an electrometer is described in U.S. Pat. No. 5,956,5 incorporated herein by this reference.

Other approaches to electrographic printing process control may be utilized, such as those described in International Publication Number WO 02/10860 A1, and International Publication Number WO 02/14957 A1, both commonly assigned herewith and incorporated herein by this reference.

Raster image processing begins with a page description generated by the computer application used to produce the desired image. The raster image processor interprets this page description into a display list of objects. This display list contains a descriptor for each text and non-text object to be printed. In the case of text, the descriptor may specifies each text character, its font, and its location on the page. For example, the contents of a word processing document with styled text is translated by the RIP into serial printer instructions that include, for the example of a binary black printer, a bit for each pixel location indicating whether that pixel is to be black or white. Binary print means an image is converted to a digital array of pixels, each pixel having a value assigned to it, and wherein the digital value of every pixel is represented by only two possible numbers, either a one or a zero. The digital image in such a case is referred to as a binary image. Multi-bit images, alternatively, are represented by a digital array of pixels, wherein the pixels have assigned values of more than two number possibilities. The RIP renders the display list into a "contone" (continuous tone) byte map for the page to be printed. This contone byte map represents each pixel location on the page to be printed by a density level (typically eight bits, or one byte, for a byte map rendering) for each color to be printed. Black text is generally represented by a full density value (255, for an eight bit rendering) for each pixel within the character. The byte map typically contains more information than can be used by the printer. Finally, the RIP rasterizes the byte map into a bit map for use by the printer. Half-tone densities are formed by the application of a halftone "screen"

to the byte map, especially in the case of image objects to be printed. Pre-press adjustments can include the selection of the particular halftone screens to be applied, for example to adjust the contrast of the resulting image.

Figure 4:
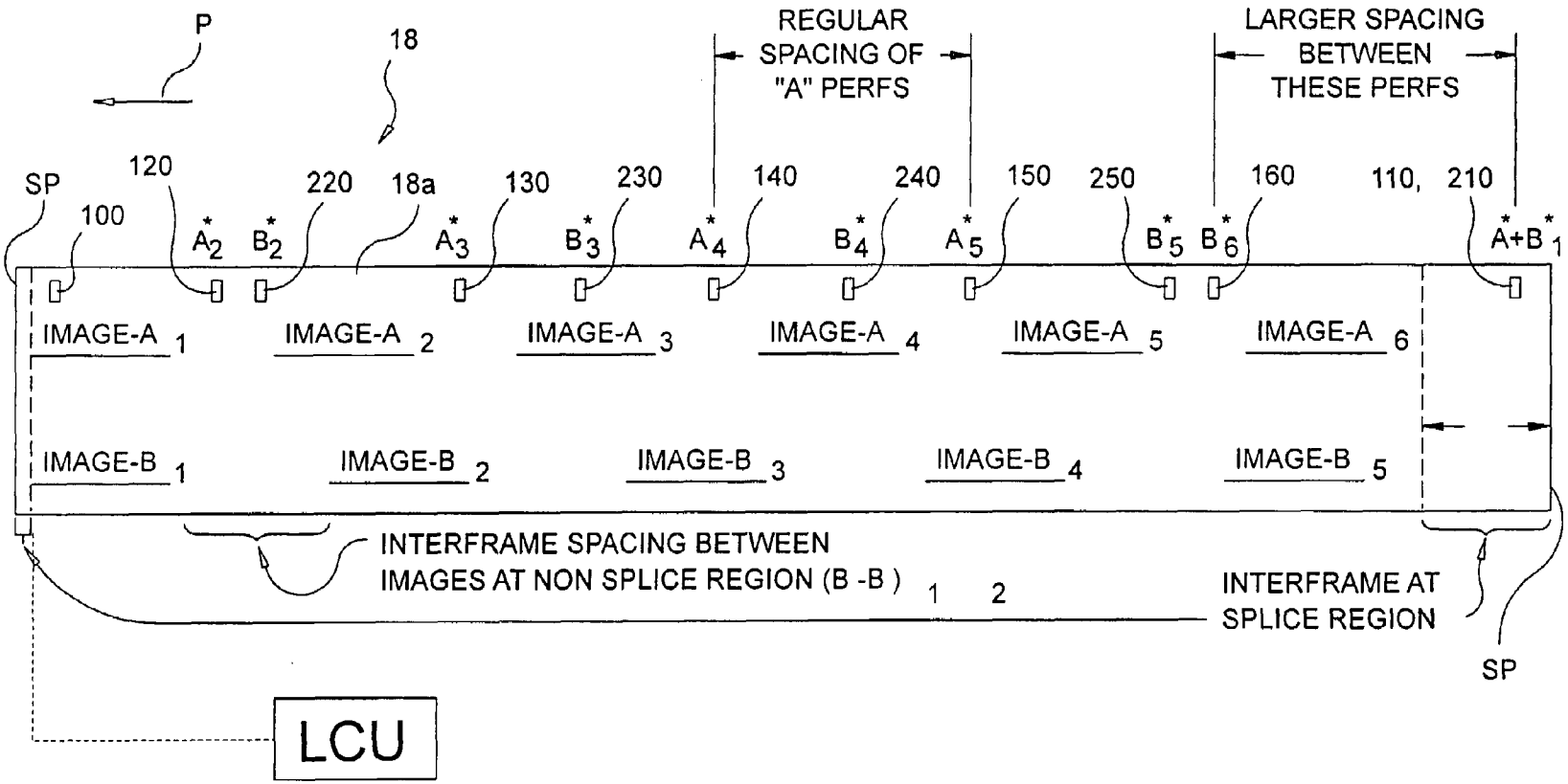
FIG. 4 is a schematic representation of a first embodiment of a photoconductive belt of the invention that has been cut at the seam so that the belt may be shown in a flat condition.

Referring now to FIG. 4, the endless imaging member belt or web 18 of the present invention is relatively long and includes a single splice or seam shown as SP. The splice SP is where two ends of the web material have been joined together in order to form its endless shape. The splice may be formed by slightly overlapping the two ends and adhesively or ultrasonically joining them together. Alternatively, the splice may be formed by butting the two ends and connecting them with tape or adhesive. Also, contemplated is use of interlocking shapes formed in the ends allowing the ends to be joined and then sealed. The splice can be formed perpendicular to the movement direction P of the belt or skewed at an angle relative thereto. Elsewhere on the imaging member 18, away from the splice SP, the surface 18*a* of the imaging member 18 has or is nominally divisible into a plural number of imaging portions or image frames which are shown as A.sub.1, A.sub.2 . . . A.sub.6 and B.sub.1, B.sub.2 . . . B.sub.5 in each of FIGS. 4 and 5. Each imaging portion or image frame as such has a predetermined length for nominally occupying a predetermined area of the surface 18*a*. The imaging member 18 also includes a non-imaging portion consisting of a relatively narrow band of the surface 18*a* adjacent to each side of the splice SP. There need not be physical and actual dividing marks between any of such image frames, instead the surface 18*a* from the beginning of image frame A.sub.1 to the end of image frame A.sub.6 is uniform and continuous with a continuous portion thereof occupying a distance along the fixed path of the member 18 relative to each of the process stations described above when the member 18 is properly registered along such path. As such, six (6) images of size A (5 of size B) can be produced consecutively at spaced locations on the continuous section, one per each such portion or image frame, when the member 18 is fully imaged during one complete revolution around the fixed path. It should be understood that the number of images is variable and may consist of any number, depending on practicality. To this end, different print jobs may specify different number of image frame configurations. The size of the images to printed will have the most influence on the number and size of image frames determined by the LCU.

For such imaging, it is necessary to start out with the imaging belt 18 in a properly registered position. In such a registered position, the imaging portions or frames each occupy a distance or portion of the fixed path so as to each be in proper working relationship relative to each one of the processing stations mounted fixedly along such distance of the path as described above, and more importantly, the non-imaging portion including the splice SP occupies a distance or portion of the fixed path such that no image will be formed over the splice or over such non-imaging portion (or interframe portion). As shown, such registration is achieved at a moment when a third sensor, for example, S.sub.1, which is mounted fixedly at a first registration point along the fixed path of belt 18, senses a valid frame indicium or indicator as passing by such sensor S.sub.1 at such moment. As shown in FIG. 4 indicia or indicators such as a perforation (or perf) (110, 210, 120, 220, 130, 230, 140, 240, 150, 250, 160) may be formed within the non-imaging portion of the member 18 (interframe area or splice area) such that the indicia move with movement of the surface 18*a* into sensing relationship with the stationary sensor S.sub.1. In FIG. 4, the perfs are also identified A*.sub.1-A*.sub.6 and B*.sub.1-B*.sub.5 to illustrate correspondence with respective image frames. An indicium 100 is also formed at a predetermined location in the splice area for sensing and control accordingly in order to properly locate the splice. The sensor S.sub.1, like other components of the printing machine 10 is connected to the logic and control unit (LCU) 24. As such, an output signal from the sensor S.sub.1 indicating the momentary sensing of the presence of the splice SP at the sensor S.sub.1 can be fed to the LCU 24 for use in initiating and controlling the functioning and operation relative to imaging member 18 of the process stations as described above. Although the indicator within the non-imaging portions are described as perfs, it is understood that other appropriate types of indicia or marks such as reflective marks can also be used cooperatively with an appropriate sensor for sensing such marks. The indicia are all formed in one row (splice indicium 100 included) adjacent one longitudinal edge and each one of the same size. The indicia may be formed in a ground stripe that runs adjacent to this edge on the imaging member 18. The indicia need not be formed in the ground stripe, but may be formed in an area of relatively high density or high absorption of light from the emitter of the perf sensor or alternatively, an area of relatively highly reflective material, such that a signal can be generated only when the indicia, such as a perf, goes by the sensor. Starting at the extreme right the first perforation 110, 210 is a common frame synchronizing perforation for use in timing the creation of a first image frame A.sub.1 of image size A and also for use in timing the creation of a first image frame B.sub.1 of image size B. Image size B has a frame width measured in the direction of movement of the belt that is greater than the corresponding dimension of an image frame used to record an image frame of image size A. The image frame size B is greater than that of A in the longitudinal direction of the belt. As an example B may represent a size receiver of standard B4 size and A may represent a size receiver of standard 8.5".times.11" size (216.times.279 mm) or A4 size (210.times.297 mm). For the size belt shown in this embodiment, six image frames each of size A (image frames A.sub.1-A.sub.6) may be recorded or formed during a production run before a splice is encountered and five image frames each of size B (image frames B.sub.1-B.sub.5) may be recorded or formed before encountering a splice. Each image frame synchronizing perforation is used for causing the writer to record an image frame in the area shown on the belt in FIG. 4 and designated image frame A.sub.1 and image frame B.sub.1, respectively. Which image size is actually formed on the belt will be determined by the image data record. Certain production jobs may mix sizes of images in a series of images. In this example, perforation 110, 210 is the perforation that is common for synchronizing image frames of different sizes. For synchronizing the second image frame or image frame A.sub.2, perforation 120 is provided. Similarly, for synchronizing the second image frame of image frame B.sub.2 a perforation 220 is provided.

The image frame, which is synchronized off of perforation 120, begins before image frame B.sub.2, which is synchronized off of perforation 220. The space between a synchronizing perforation (or an edge of a perforation if this is the feature of the perforation that is specifically detected) and the corresponding leading edge of the image frame is generally the same on the belt but need not be. If this distance is constant then the beginnings of image frames A.sub.2 and B.sub.2 are offset from each other the same amount as the spacing between corresponding parts of perforations 120 and 220. However, the synchronization timing for the image frames of the B series may be different than that of the image frames of the A series.

As can be seen in FIG. 4, a series of perforations 110, 120, 130, 140, 150 and 160 are provided for synchronizing image frames A.sub.1, A.sub.2, A.sub.3, A.sub.4 and A.sub.5 and A.sub.6 respectively. B series perforations to 210, 220, 230, 240, and 250 are provided for synchronizing image frames B.sub.1, B.sub.2, B.sub.3, B.sub.4, and B.sub.5 respectively. The perforations are located to be in a preceding interframe area when that respective size image frame is formed. This is because the synchronizing of commencement of writing can be relatively quickly done as the next image frame to be written is fully rasterized, stored in a job image buffer memory and sitting and waiting to be output to the writer line by line for printing. Various perforation sensors may be placed along the path of the belt to synchronize operations with respective stations. Thus, the transfer station may have its own sensor for sensing a perforation or other frame identifying indicia for synchronizing movement of paper receivers into the transfer station. For example, a single perf sensor S.sub.1 that senses each perforation as they serially pass beneath the sensor and is used by the LCU to control timing functions generally other than paper receiver feeding may be used. An encoder wheel 21*b* operates in response to rotation of roller 21*a* to generate encoder pulses representing increments of movement of the web 18 along its path of movement referred to as the process direction of the web 18. Upon synchronizing exposure of an image frame at the exposure station 34, the position of the leading edge of that image can be tracked by the LCU through counting of encoder pulses from the time of detection of the perf associated with that image frame. The LCU is programmed to store counts associated with each image frame relative to its movement along the closed path for synchronizing various process operations, such as transfer and, thus, when to feed a receiver sheet into the transfer station.

Interframe areas may be located in the splice region as shown in FIG. 4 that is larger than that between images at non-splice regions. This allows other operations sufficient time to be operated or stabilized. For example, it may be desirable to reverse bias the transfer roller 46*b* when the interframe passes beneath the transfer area. This is desirably done to preclude toner accumulating at the splice from transferring to the transfer roller as no receiver is between the roller and belt at this time. Because of the capacitance of the roller it may take time for this reverse biasing of this roller to become totally effective.

Figure 5:
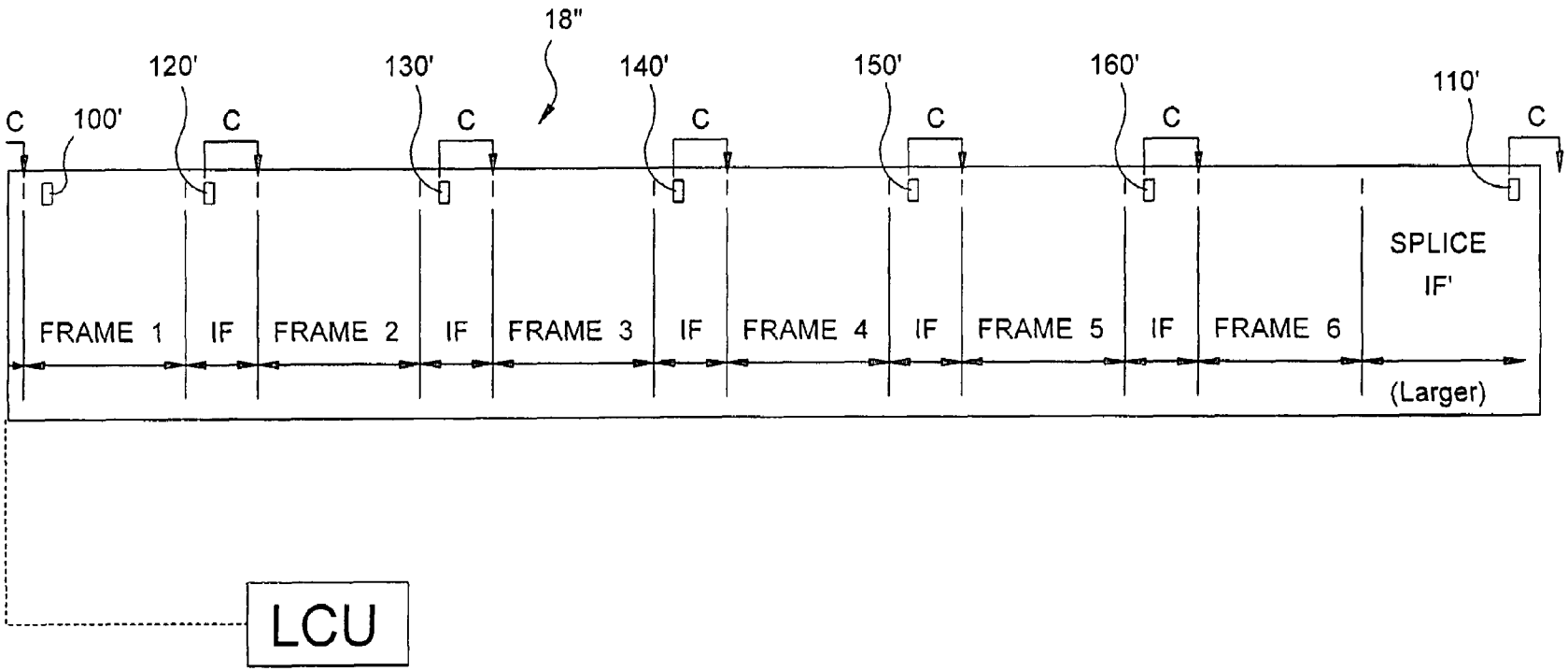
FIG. 5 is a schematic representation of a second embodiment of a photoconductive belt of the invention that has been cut at the seam so that the belt may be shown in a flat condition.

In FIG. 5, an example of an endless photoconductive imaging belt is illustrated which only includes a series of A image frame perfs, the perforations corresponding to the A frame perfs of FIG. 4 are identified with a similar numeral with a single prime (').

As an alternate embodiment to FIG. 5, a photoconductive belt may be provided wherein the frame synchronizing perfs may be uniformly spaced from each other so that there is provided an interframe area that includes the splice that is equal in size to that of the other interframe areas.

It may be desired to locate the seam when the apparatus is stopped so that the seam is at a location other than the transfer location. A count may be stored in memory for such a location and substituted for the count used to park the seam at the transfer location when, for example, a service technician wishes to have the seam be at that other location for analysis.

A quality check of the photoconductive belt 18 may performed by "writing" a toner image on each of the virtual image frames of the loop and printing out those images. This quality check image may be any image suitable for testing the print integrity of the frames of the film loop. The image may be one that exits in the current, previous, or subsequent print job or it may be a preselected image to accomplish this objective. The image may be the same for each film frame or it may vary according to the quality test to be exercised for that frame. To this end, to make image frame correlation easier, the images for each film frame may vary to the extent that the number indicative of the film frame number may be writing so that when the image is eventually printed on the respective receiver, the receiver will indicate which film frame the image came from. The printer user interface may provide a test screen to prompt a user to perform such a quality check. To facilitate the printing of sample receivers for each frame of a printer's film loop a user button is provided at the user interface. When selected, this signals the marking engine to schedule for print an appropriate number of receivers such that each frame on the film belt will be printed on. Each receiver may be a duplicate copy of a particular receiver in the currently printing job. For instance, if the film loop is divided into 6 frames, six receivers would be printed on and delivered to a finishing exit when in simplex mode and 3 receivers would be delivered when in duplex mode. Once the receivers are printed on, a print operator may read or inspect the receivers for defects in the printed images. Defects in the images may be the result of or indicative of defects on the film loop. If there is a defect on the film loop, the operator can identify which section is defective by the identified receiver.

The user may request a printer enhanced sample receiver mode (ESSM) which would be sent to the marking engine LCU 24 which schedules the printing of receivers. If the LCU has no print jobs queued that will need scheduling, then the ESSM request is rejected or postponed. If the LCU is currently scheduling the printing of receivers, the ESSM request is accepted. When the next receiver in the customer job is about to be scheduled, the LCU creates a duplicate of this receiver and schedules this receiver. The first receiver is scheduled such that it will be printed on virtual image frame number 1. The virtual frame numbers remain in the same relationship to actual frame numbers or printed receivers as long as the marking engine remains printing (note, remaining printing is not the same as remaining running). Therefore, the first test image will always represent the same actual frame as long as the marking engine remains printing. Subsequent ESSM receivers are scheduled using the same scheduling algorithm as normal receivers. The LCU keeps track of which frame or frames have been utilized (printed on) by an ESSM receiver. Additional ESSM receivers are scheduled until all the frames on the film belt have been utilized. Due to the complex nature of a typical scheduling algorithm, it is possible that all frames on the film belt may not be utilized. If a safe guard was not in place, the number of ESSM receivers printed could become very large. Therefore, if after scheduling 10 ESSM receivers, each of the possible actual frames have not been printed then the LCU will stop printing ESSM receivers and resume printing the normal receivers.

If the customer's job used during the ESSM is duplex then the ESSM receivers will be duplexed. If the customer's job used during the ESSM is simplex then the ESSM receivers will be simplex. The ESSM receivers will also be printed on the same paper as the customer's receiver. Since the ESSM receivers use the same paper, these ESSM receivers will also be printed in the same frame mode. If the paper used requires multiple frames then this frame usage is credited accordingly.

The following table shows some examples of the customer's receivers selected for ESSM and the number of ESSM receivers printed.

| Customer's receiver selected for ESSM | Number of ESSM receivers printed |
|---|---|
| simplex, single frame paper, 6 frame mode | 6 |
| simplex, single frame paper, 5 frame mode | 5 |
| simplex, 2 frame paper, 6 frame mode | 3 |
| duplex, single frame paper, 6 frame mode | 3 |
| duplex, 2 frame paper, 6 frame mode | 2 |

The actual film frame numbers may be synchronized with the virtual frame numbers used during the scheduling of the sample receivers. This enables the sub-system that schedules the receiver to ensure that the receivers are printed on specific frames on the belt and printed in a consistent manner. The first sample receiver may be printed on the first frame and subsequent receivers printed on subsequent frames. The image frames may be exposed with numbers as shown, and the numbers being subsequently printed onto the respective receivers to help correlate receivers to image frames. An operator may keep track of the receiver to image frame correlation through other methods.

Rather than creating ESSM receivers from the customer job, special test images may be printed. These special images would make it easier for the user to identify film belt damage and which frame has the damage.

Once the user determines that a particular frame is damaged/unusable, the marking engine could be programmed to disable this frame. The disabled frame would not be printed on again. This feature would allow the print jobs to continue printing but with lower productivity until the film belt is replaced.

Figure 6:
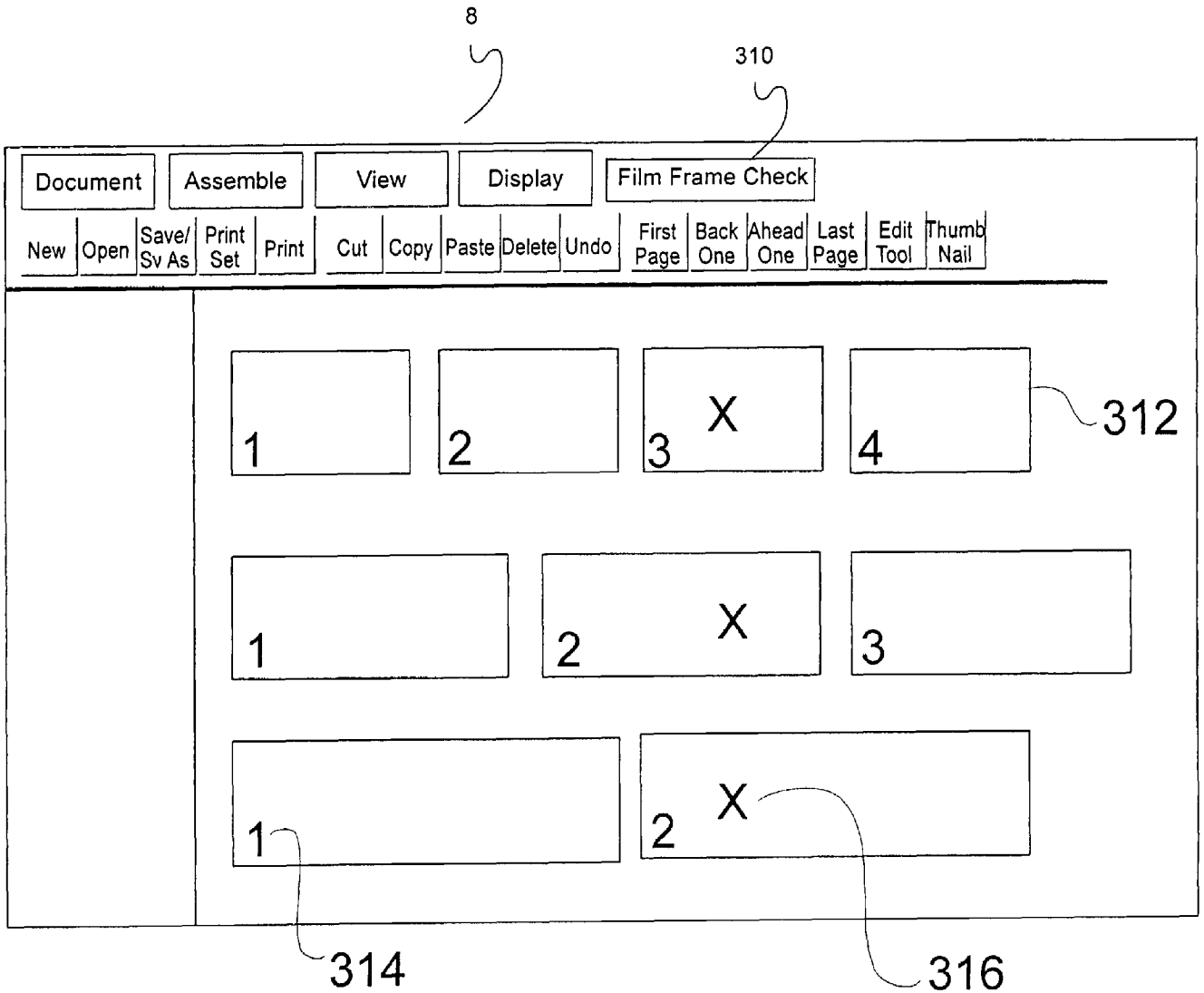
FIG. 6 is a schematic representation of a graphic user interface for implementing the present invention.

Referring now to FIG. 6, which illustrates a graphic user interface (GUI) 8 for controlling the printer 8. A film frame check button 310 may be provided for initiating the film frame quality check routine described herein. Once selected, the printer LCU prints out the quality check images onto the respective receivers. This dedicated button when selected may remain in the selected state until such time that the sample receivers are delivered to the finishing exit. When the receivers are delivered to their final destination the Film Check Button will return to its unselected state and provide an indication that the operation has been completed and the samples are ready to be retrieved for evaluation. The GUI may display representations 312 of the image frames, and different numbers of image frames per image loop for different types of print jobs. For example, some print jobs might require 6 frames on the loop while others require 3, etc. The frames numbers 314 may be identified on the GUI. The frame numbers may also be printed on the respective receivers with the test image as described herein. FIG. 6 illustrates an example of how frames may be selected for disablement by marking them on the GUI with an appropriate mark 316. It can be seen that the appropriate film frames are disabled regardless of how many frames per loop is selected for a particular print job.

Although the invention has been shown and described with exemplary embodiments thereof, it should be understood by those skilled in the art that the foregoing and various other changes, omissions and additions may be made therein and thereto without departing from the spirit and scope of the invention.

It should be understood that the programs, processes, methods and apparatus described herein are not related or limited to any particular type of computer or network apparatus (hardware or software), unless indicated otherwise. Various types of general purpose or specialized computer apparatus may be used with or perform operations in accordance with the teachings described herein. While various elements of the embodiments have been described as being implemented in software, in other embodiments hardware or firmware implementations may alternatively be used, and vice-versa.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more, fewer or other elements may be used in the block diagrams.

The claims should not be read as limited to the described order or elements unless stated to that effect. In addition, use of the term "means" in any claim is intended to invoke 35 U.S.C. §112, paragraph 6, and any claim without the word "means" is not so intended. Therefore, all embodiments that come within the scope and spirit of the following claims and equivalents thereto are claimed as the invention.

| PARTS LIST | |
|---|---|
| 2 | print system |
| 4 | media treatment system |
| 6 | media supply |
| 8 | user interface |
| 10 | marking engine |
| 12, 14 | stacking device |
| 13 | inserting device |
| 16 | finishing device |
| 18 | belt or loop |
| 18a | surface |
| 20 | motor |
| 21a | roller |
| 21a-21g | supports |
| 24 | logic and control unit |
| 28 | charging station |
| 30 | programmable voltage controller |
| 32 | writer interface |
| 34 | exposure station |
| 34a | writer |
| 35 | development station |
| 35a | backup roller |
| 36 | image data source |
| 37 | raster image processor |
| 38 | marking image processor |
| 39 | image render circuit |
| 40 | programmable controller |
| 42 | toner auger |
| 46 | transfer station |
| 46a | programmable voltage controller |
| 46b | roller |
| 48 | cleaning station |
| 49 | fuser station |
| 50 | electrometer probe |
| 60 | drivers |
| 76 | densitometer |
| 110 | perforation |
| 114 | test patch |
| 120 | perforation |
| 130 | perforation |
| 140 | perforation |
| 150 | perforation |
| 160 | perforation |
| 210 | perforation |
| 220 | perforation |
| 230 | perforation |
| 240 | perforation |
| 250 | perforation |
| 310 | film frame check button |
| 312 | representations |

-continued

| PARTS LIST | |
|---|---|
| 314 | frames numbers |
| 316 | mark |
| A | image size |
| B | image frame size |
| P | direction/arrow |
| S | receiver sheet |
| SP | splice |

The invention claimed is:

1. A method for testing a film loop of a print engine, the film loop having a plurality of virtual image frames, the method comprising the steps of:

scheduling a print job from a queue, said print job having a plurality of print job images;

receiving a quality check request from an operator;

scheduling a plurality of quality check images between two of said print job images responsive to said request, said quality check images each corresponding to a respective one of the virtual image frames of the film loop, said quality check images being additional to said print job;

writing a toner image of each of said print job images and each of said quality check images on said film loop in accordance with said scheduling, wherein said toner images of said quality check images are each written on the corresponding said virtual film frame of said film loop;

printing said toner images of each of said print job images and of said quality check image to individual receivers to provide both a plurality of print job receivers having respective said print job images and a quality check receiver having said quality check image, said printing to said receivers being in accordance with said print job and said scheduling;

examining said quality check image and identifying any defective virtual image frames; and continuing printing said print job on said film loop around any defective virtual image frames to print at maximum efficiency.

2. The method of claim 1 further comprising creating a duplicate of one of said print job images to provide said quality check image.

3. The method of claim 1 wherein said printing of said quality check receiver is simplex when said printing of said print job receivers is simplex, and duplex when said printing of said print job receivers is duplex.

4. The method of claim 3 wherein said printing of said toner images of each of said print job images is to respective receivers of a paper media and said printing of said toner image of said quality check receiver is to another receiver of the same type of paper media.

5. The method of claim 1 wherein said printing of said toner images of each of said print job images is to respective receivers of a paper media and said printing of said toner image of said quality check receiver is to another receiver of the same type of paper media.

6. The method of claim 1 wherein said quality check request is initiated by an operator selecting a button and said method further comprises retaining said button as selected until said printing of said toner images of said quality check images is completed.

7. The method of claim 1 further comprising:

displaying representations of said virtual image frames;

identifying frame numbers of said displayed virtual image frames during said displaying; and including said frame numbers in corresponding said quality check images.

8. The method of claim 1 wherein said receiving is during or prior to said scheduling of said print job.

9. A printer for printing a print job on receivers, the print job having a plurality of images, the printer comprising:

a print engine having a film loop having a plurality of virtual image frames;

a user interface including a quality check button;

a controller operatively connected to said print engine and said user interface, said controller scheduling the print job from a queue, said controller scheduling a plurality of quality check images responsive to a selection of said quality check button by an operator, said quality check images each corresponding to a respective one of the virtual image frames of the film loop, said quality check images being additional to said print job, said controller causing said print engine to write a toner image of each of said print job images and each of said quality check images on said film loop in accordance with said scheduling, wherein said toner images of said quality check images are each written on the corresponding said virtual film frame of said film loop, said controller causing said print engine to print said toner images of each of said print job images and of said quality check image to individual receivers in accordance with said print job and said scheduling, to provide both a group of print job receivers having said plurality of print job images and a quality check receiver having said quality check image, said quality check image being examined and any defective virtual image frames identified such that continued printing said print job on said film loop can occur around any defective virtual image frames to print at maximum efficiency.

10. The printer of claim 9 wherein said controller creates a duplicate of one of said print job images to provide said quality check image.

11. The printer of claim 9 said controller causes said print engine to print said toner image of said quality check image as simplex, when said toner images of said print job images are printed simplex, and duplex said toner images of said print job images are printed duplex.

12. The printer of claim 11 wherein said controller causes said print engine to print said toner images of each of said print job images to respective receivers of a paper media and to print said toner image of said quality check receiver to another receiver of the same type of paper media.

13. The printer of claim 9 wherein said controller causes said print engine to print said toner images of each of said print job images to respective receivers of a paper media and to print said toner image of said quality check receiver to another receiver of the same type of paper media.

14. A method for testing a film loop of a print engine, the film loop having a plurality of virtual image frames, the method comprising the steps of:

scheduling a print job from a queue, said print job having a plurality of print job images;

receiving a quality check request from an operator;

scheduling a plurality of quality check images between two of said print job images responsive to said request, said quality check images each corresponding to a respective one of the virtual image frames of the film loop, said quality check images being additional to said print job images;

writing a toner image of each of said print job images and each of said quality check images on said film loop in accordance with said scheduling, wherein said toner images of said quality check images are each written on the corresponding said virtual film frame;

printing said toner images of each of said print job and quality check images to individual receivers to provide print job receivers having respective said print job images and quality check receivers having respective said quality check images, said printing to said receivers being in accordance with said print job and said scheduling displaying representations of said virtual image frames;

identifying frame numbers of said displayed virtual image frames during said displaying;

including said frame numbers in corresponding said quality check images; and examining said quality check image and identifying any defective virtual image frames, and continuing printing said print job on said film loop around any defective virtual image frames to print at maximum efficiency.

15. The method of claim 14 wherein said quality check request is initiated by an operator selecting a button and said method further comprises retaining said button as selected until said printing of said toner images of said quality check images is completed.

16. The method of claim 14 wherein said receiving is during or prior to said scheduling of said print job.

* * * * *